US007088080B2

(12) United States Patent
Kameda et al.

(10) Patent No.: US 7,088,080 B2
(45) Date of Patent: Aug. 8, 2006

(54) POWER SUPPLY CIRCUIT FOR VACUUM FLUORESCENT DISPLAY

(75) Inventors: Masashi Kameda, Mie (JP); Kazuhisa Shibata, Mie (JP); Hiroshi Nakanishi, Mie (JP); Shinichi Terakami, Mie (JP); Toshihide Eguchi, Mie (JP)

(73) Assignees: Noritake Co., Ltd., Aichi (JP); Noritake Itron Corporation, Mie (JP)

( * ) Notice: Subject to any disclaimer, the term of this patent is extended or adjusted under 35 U.S.C. 154(b) by 113 days.

(21) Appl. No.: 10/922,767

(22) Filed: Aug. 19, 2004

(65) Prior Publication Data

US 2005/0046402 A1 Mar. 3, 2005

(30) Foreign Application Priority Data

Aug. 27, 2003 (JP) ..... 2003-302538
Dec. 16, 2003 (JP) ..... 2003-418233

(51) Int. Cl.
*G05F 1/10* (2006.01)

(52) U.S. Cl. ..... 323/222; 363/68; 315/291

(58) Field of Classification Search ..... 323/222, 323/225, 282–285, 271, 272; 363/53, 89, 363/60; 315/291, 308, 224, 225
See application file for complete search history.

(56) References Cited

U.S. PATENT DOCUMENTS 5,028,861 A * 7/1991 Pace et al. ..... 323/222

FOREIGN PATENT DOCUMENTS

JP 2002-260565 A 9/2002
JP 2003-029711 A 1/2003

* cited by examiner

*Primary Examiner*—Rajnikant B. Patel
(74) *Attorney, Agent, or Firm*—Blakely Sokoloff Taylor & Zafman

(57) ABSTRACT

A power supply circuit for a vacuum fluorescent display includes a boosting coil, input terminal, switching transistor, PWM control circuit, boosting circuit, first filament terminal, and second filament terminal. The boosting coil is provided in a current path to generate an induced voltage in accordance with a change in current flowing therein. The input terminal receives a DC voltage to be applied to one terminal of the boosting coil. The switching transistor is provided between the other terminal of the boosting coil and a ground line. The PWM control circuit periodically turns on/off the switching transistor. The boosting circuit generates a boosted voltage on the basis of an induced voltage generated at the other terminal of the boosting coil when the switching transistor is switched from ON to OFF. The first terminal is connected to the node between the other terminal of the boosting coil and the switching transistor. A DC voltage lower than the induced voltage generated at the other terminal of the boosting coil is applied to the second terminal.

3 Claims, 11 Drawing Sheets

POWER SUPPLY CIRCUIT FOR VACUUM FLUORESCENT DISPLAY

BACKGROUND OF THE INVENTION

The present invention relates to a power supply circuit attached to a vacuum fluorescent display.

A vacuum fluorescent display is an electron tube which displays a desired pattern by causing electrons emitted from the cathode in the vacuum vessel (envelope) having at least one side which is transparent to impinge on the phosphor applied to the anode and causing the phosphor to emit light. In general, as this vacuum fluorescent display, a display having a triode structure with a grid for controlling the behavior of electrons is most frequently used.

FIG. 15 shows a conventional general vacuum fluorescent display tube and a circuit attached to the vacuum fluorescent display (see Japanese Patent Laid-Open No. 2002-260565 (reference 1)). Referring to FIG. 15, reference numeral 1 denotes a vacuum fluorescent display tube; and 400, a power supply circuit attached to the vacuum fluorescent display tube 1. In the vacuum fluorescent display tube 1, an evacuated envelope 2 incorporates an anode 5 comprised of a plurality of anode electrodes 4 coated with a phosphor 3, a cathode 6 placed to oppose the upper surface of the anode 5, and a grid 7 which is placed between the anode 5 and the cathode 6 to control electrons emitted from the cathode 6. The anode 5 is formed on an anode substrate 8.

In this case, the cathode 6 is a filament coated with an electron emitting material. The cathode 6 is connected to an AC power supply 10 via a center-tapped transformer 9 and is grounded (GND) via the center tap of the transformer 9. With this structure, an AC filament voltage Ef is applied across the cathode 6 (between terminals F1 and F2).

The grid 7 is formed in a mesh pattern and receives a DC voltage VDD2 from a boosting circuit 11. Each anode electrode 4 is connected to a driving circuit 12. The driving circuit 12 also receives the DC voltage VDD2 from the boosting circuit 11. The boosting circuit 11 generates the DC voltage VDD2 for the anode/grid by boosting an input voltage Vin (DC voltage). The driving circuit 12 ON/OFF-controls a positive voltage to be applied to each anode electrode 4 on the basis of input display data.

[Cutoff Voltage]

In a vacuum fluorescent display, when the filament potential drops below the turn-off level of the anode potential, light emission leakage may occur. That is, the filament potential needs to be higher than the turn-off level of the anode potential. This filament potential is called a cutoff voltage.

Referring to FIG. 15, the average voltage (average voltage on filament terminal F1 side) between one terminal of the cathode 6 and the GND is equal to the average voltage (average voltage on filament terminal F2 side) between the other terminal of the cathode 6 and the GND. This average voltage of the cathode 6 is set as a cutoff voltage. This cutoff voltage can be adjusted by the value of a resistor RC1 connected between the GND and the center tap of the transformer 9.

In the above conventional power supply circuit 400, however, since the AC filament voltage Ef is obtained by using the transformer 9, problems (1) to (4) are posed as follows:

(1) producing much noise;

(2) requiring much cost and time for the design of a power supply;

(3) causing flicker when displaying a desired pattern on the vacuum fluorescent display tube 1; and (4) requiring a large power consumption.

SUMMARY OF THE INVENTION

It is an object of the present invention to eliminate the necessity of a filament-driving transformer and achieve low noise.

It is another object of the present invention to shorten the time required for the design of a power supply.

It is still another object of the present invention to prevent flicker when a desired pattern is displayed on a vacuum fluorescent display tube.

It is still another object of the present invention to achieve low power consumption.

In order to achieve the above objects, according to the present invention, there is provided a power supply circuit for a vacuum fluorescent display, comprising an induction element which is provided in a current path to generate an induced voltage in accordance with a change in current flowing therein, an input terminal for a DC voltage to one terminal of the induction element, a switching element which is provided between the other terminal of the induction element and a ground line, a control circuit which periodically turns on/off the switching element, a boosting circuit which generates a boosted voltage on the basis of an induced voltage generated at the other terminal of the induction element when the switching element is switched from ON to OFF, a first terminal connected to a node between the other terminal of the induction element and the switching element, and a second terminal to which a DC voltage lower than the induced voltage generated at the other terminal of the induction element is applied.

DESCRIPTION OF THE PREFERRED EMBODIMENTS

The present invention will be described in detail below with reference to the accompanying drawings.

[First Embodiment]

Figure 1:
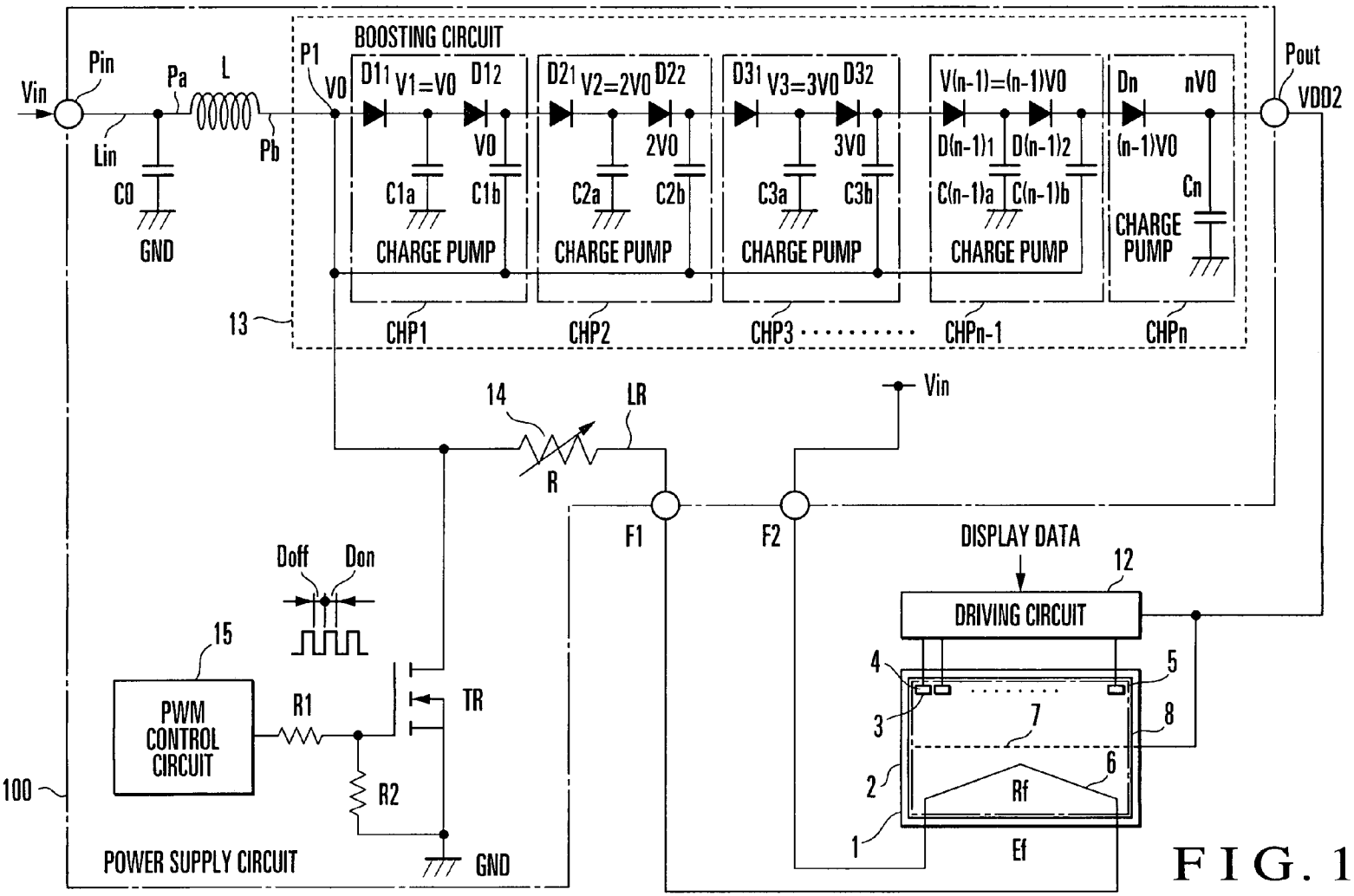
FIG. 1 is a circuit diagram showing the main part of a power supply circuit according to an embodiment (first embodiment) of the present invention.

FIG. 1 shows the main part of a power supply circuit according to an embodiment (first embodiment) of the present invention. A power supply circuit 100 includes a capacitor (input smoothing capacitor) C0, a boosting coil (induction element) L, a boosting circuit 13, a switching transistor (field-effect transistor) TR, a variable resistor (voltage adjustment resistor) 14, a PWM control circuit 15, and resistors R1 and R2. The power supply circuit has an input terminal Pin, output terminal Pout, filament terminal F1 (first terminal), and a filament terminal F2 (second terminal).

An input voltage (DC voltage) Vin is applied to the input terminal Pin. A DC voltage VDD2 for the anode/grid is output from the output terminal Pout. A cathode (filament) 6 of a vacuum fluorescent display tube 1 is connected between the filament terminals F1 and F2.

In the power supply circuit 100, the boosting coil L is provided in a current path Lin between the input terminal Pin and the boosting circuit 13, and generates an induced voltage in accordance with a change in current flowing in the current path Lin. The input smoothing capacitor C0 is connected between the node between a ground line and one terminal Pa of the boosting coil L and the input terminal Pin. The other terminal Pb of the boosting coil L is connected to the drain of the switching transistor TR. The source of the switching transistor TR is grounded (GND). The PWM control circuit 15 is connected to the gate of the switching transistor TR via the resistor R1.

The PWM control circuit 15 periodically generates a pulse signal with a predetermined duty ratio [letting a ratio Vin/V0 of Vin to V0 (to be described later) be an off duty Doff (Doff=Vin/V0), and the ratio of (V0−Vin) to V0 be an on duty Don (Don=(V0−Vin)/V0)], and supplies the pulse signal to the gate of the switching transistor TR via the resistor R1. Note that in the PWM control circuit 15, the period and duty ratio of a pulse signal can be adjusted.

A node P1 between the other terminal Pb of the boosting coil L and the drain of the switching transistor TR is connected to the filament terminal F1 via the voltage adjustment resistor 14. That is, the voltage adjustment resistor 14 is connected to a connection line LR between the filament terminal F1 and the node P1 between the other terminal Pb of the boosting coil L and the switching transistor TR. The input voltage (DC voltage) Vin is applied to the filament terminal F2.

The boosting circuit 13 includes n charge pumps CHP1 to CHPn. The charge pump CHP1 is comprised of diodes (rectifying diodes) $D1_1$ and $D1_2$ and capacitors (output smoothing/charge pump capacitors) C1*a* and C1*b*. The anode of the diode $D1_1$ is connected to one terminal of the boosting coil L, and the cathode of the diode $D1_1$ is connected to the anode of the diode $D1_2$. One terminal of the capacitor C1*a* is connected to the cathode of the diode $D1_1$ and the anode of the diode $D1_2$. The other terminal of the capacitor C1*a* is grounded. One terminal of the capacitor C1*b* is connected to the cathode of the diode $D1_2$, and the other terminal is connected to the other terminal Pb of the boosting coil L, i.e., the node P1 between the boosting coil L, boosting circuit 13, and switching transistor TR.

The charge pumps CHP2 to $CHPn_{-1}$ have the same arrangement as that of the charge pump CHP1. The last charge pump CHPn is comprised of a diode Dn and capacitor Cn. The anode of the diode Dn is connected to the cathode of a diode $D(n-1)_2$ of the immediately preceding charge pump $CHPn_{-1}$, and the cathode of the diode Dn is connected to the output terminal Pout. The capacitor Cn is connected between the cathode of the diode Dn and the ground line.

[Boosting Operation]

The PWM control circuit 15 periodically generates a pulse signal with a predetermined duty ratio, and supplies it to the gate of the switching transistor TR via the resistor R1. The switching transistor TR repeatedly performs ON/OFF operation in accordance with this pulse signal. In this case, when the switching transistor TR is switched from ON to OFF, a voltage (induced voltage) V0 higher than the input voltage Vin is generated at the node P1 between the boosting coil L and the switching transistor TR.

The voltage V0 is applied to the boosting circuit 13. In the boosting circuit 13, the capacitor C1*a* of the charge pump CHP1 is charged by the voltage V0 generated at the node P1 via the diode $D1_1$, and a charged potential V1 of the pump becomes V0 (V1=V0). When the switching transistor TR is switched from OFF to ON, the capacitor C1*b* is charged by the charged potential V1 of the capacitor C1*a* via the diode $D1_2$, and the charged potential of the capacitor becomes V0. When the switching transistor TR is switched from ON to OFF again, the charged potential V0 of the capacitor C1*b* is raised by the induced voltage V0 generated at the node P1, and a charged potential V2 of a capacitor C2*a* in the charge pump CHP2 becomes 2V0 (V2=2V0 ).

Subsequently, as this operation is repeated, the voltage V0 generated at the node P1 is sequentially boosted by the charge pumps CHP1 to CHPn. As a consequence, a voltage nV0 is obtained as the DC voltage VDD2 for the anode/grid (VDD2=nV0) from the output terminal Pout. That is, by causing the voltage V0 generated at the node P1 to pass through the boosting circuit 13, the DC voltage VDD2 for the anode/grid n times higher than the voltage V0 can be obtained. The value of the DC voltage VDD2 for the anode/grid can be adjusted by the on duty Don of the switching transistor TR and the number of charge pumps in the boosting circuit 13.

[Filament Voltage]

[Waveform at F1]

Figure 2:
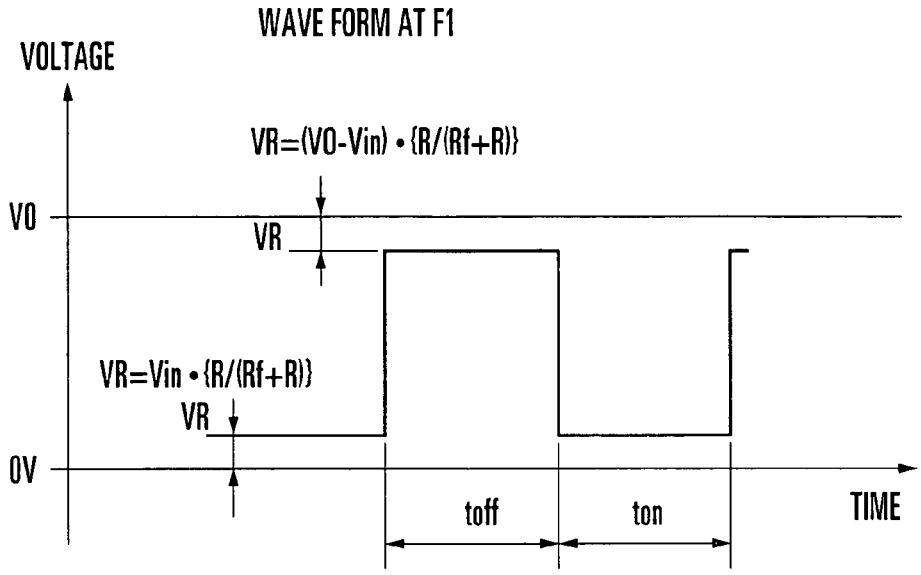
FIG. 2 is a chart showing a voltage waveform (waveform at F1) appearing at a filament terminal F1 in the first embodiment.

FIG. 2 shows a voltage waveform (waveform at F1) appearing at the filament terminal F1 along with the above boosting operation. Referring to FIG. 2, reference symbol ton denotes the ON time of the switching transistor TR, and toff, the OFF time of the switching transistor TR. In the following description, voltage drops at the switching transistor TR, a diode D, and a capacitor C and the like are ignored.

When the switching transistor TR is ON, since the filament terminal F1 is grounded via the voltage adjustment resistor 14, a voltage higher than 0V than voltage drop VR at the voltage adjustment resistor 14 appears. In this case, letting Rf be the resistance of the cathode 6, and R be the resistance of the voltage adjustment resistor 14, the voltage drop VR at the voltage adjustment resistor 14 is represented by VR=Vin·{R/(Rf+R)} because the potential of the filament terminal F2 is Vin. Therefore, the potential of the filament terminal F1 is given by VR=Vin ·{R/(Rf+R)}.

When the switching transistor TR is OFF, since the voltage V0 generated at the node P1 is applied to the filament terminal F1 via the voltage adjustment resistor 14, a voltage lower than the voltage V0 by the voltage drop VR at the voltage adjustment resistor 14 appears. In this case, the voltage drop VR at the voltage adjustment resistor 14 is represented by VR=(V0−Vin)·{R/(Rf+R)} because the potential at the node P1 at this time is V0. The potential of the filament terminal F1 is therefore represented by V0−(V0−Vin)·{R/(Rf+R)}.

[Waveform Between F1 and F2]

Figure 3:
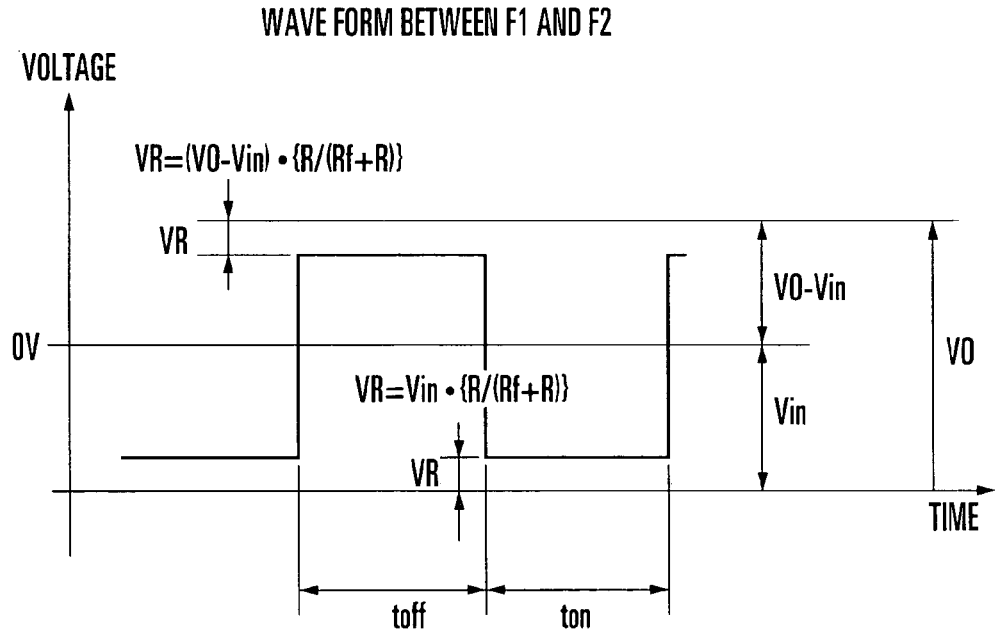
FIG. 3 is a chart showing a waveform (waveform between F1 and F2) between filament terminals F1 and F2 in the first embodiment.

A voltage waveform (waveform between F1 and F2) between the filament terminals F1 and F2 becomes similar to that shown in FIG. 3 with the input voltage Vin applied to the filament terminal F2 being a reference and the filament terminal F1 side being the "+" side. That is, the voltage applied across the filament 6 becomes a voltage with a rectangular waveform (AC filament voltage) owing to periodic ON/OFF switching of the switching transistor TR.

In this case, the effective value of the filament voltage Ef applied across the filament 6 is represented by $$Ef=\{Vin\cdot(V0=Vin)\}^{1/2}\cdot\{Rf/(Rf+R)\} \quad (1)$$

As is obvious from equation (1), the filament voltage Ef can be adjusted by the resistance R of the voltage adjustment resistor 14 and the voltage V0. Note that since VDD2=nV0 and V0=VDD2/n, V0 is determined by the number of charge pumps in the boosting circuit 13. That is, the value of V0 can be changed by changing the number of charge pumps.

Note that without the voltage adjustment resistor 14 (R=0), the effective value of the filament voltage Ef is represented by $$Ef=\{Vin\cdot(V0-Vin)\}^{1/2} \quad (2)$$

[Cutoff Voltage]

In the power supply circuit 100, average voltages VF1 and VF2 at the filament terminals F1 and F2 are represented by VF1=VF2=Vin. For example, without the voltage adjustment resistor 14 (R=0 Ω), $$VF1=V0\cdot Doff=V0\cdot(Vin/V0)=Vin$$

Since VF2=Vin (connected to Vin), $$VF1=VF2=Vin$$

With the voltage adjustment resistor 14, $$\begin{aligned} VF1 &= \{V0-(V0-Vin)\cdot(R/(Rf+R)\}\cdot Doff+Vin\cdot(R/(Rf+R))\cdot Don \\ &= \{V0-(V0-Vin)\cdot(R/(Rf+R))\}\cdot(Vin/V0)+Vin\cdot(R/(Rf+R))\cdot((V0-Vin)/V0) \\ &= \{1-(R/(Rf+R))\}\cdot Vin+Vin\cdot(R/(Rf+R)) \\ &= Vin\cdot\{(Rf/(Rf+R)+(R/(Rf+R))\}=Vin \end{aligned}$$

Since VF2=Vin (connected to Vin), $$VF1=VF2=Vin$$

The cutoff voltage (the potential of the filament at which luminance becomes zero when the anode is OFF) at the filament terminal F1 can be made equal to that at the filament terminal F2. In addition, potential difference VR (VR=Vin·{R/(Rf+R)}) between the minimum value of the filament potential and the ground potential can be arbitrarily set by adjusting the resistance R of the voltage adjustment resistor 14.

[Variation Ratio of Ef upon Variation in Vin]

The variation ratio of Ef upon variation in Vin was obtained by an actual device. This made it possible to confirm that the filament voltage Ef was stable even if the range of Vin was large.

(1) When V0=10 V $$Vin=4.5\ V:\ Ef=\{4.5\cdot(10-4.5)\}^{1/2}=4.97\ Vrms$$

$$Vin=5.0\ V:\ Ef=\{5\cdot(10-5)\}^{1/2}=5.00\ Vrms$$

$$Vin=5.5\ V:\ Ef=\{5.5\cdot(10-5.5)\}^{1/2}=4.97\ Vrms$$

When Vin varies in the range of ±10%, Ef varies in the range of ±0.6%.

(2) When V0=10 V $$Vin=4.0\ V:\ Ef=\{4.0\cdot(10-4.0)\}^{1/2}=4.90\ Vrms$$

$$Vin=5.0\ V:\ Ef=\{5\cdot(10-5)\}^{1/2}=5.00\ Vrms$$

$$Vin=6.0\ V:\ Ef=\{6.0\cdot(10-6.0)\}^{1/2}=4.90\ Vrms$$

When Vin varies in the range of ±20%, Ef varies in the range of ±2%.

(3) When V0=15 V $$Vin=4.5\ V:\ Ef=\{4.5\cdot(15-4.5)\}^{1/2}=6.87\ Vrms$$

$$Vin=5.0\ V:\ Ef=\{5\cdot(15-5)\}^{1/2}=7.07\ Vrms$$

$$Vin=5.5\ V:\ Ef=\{5.5\cdot(15-5.5)\}^{1/2}=7.23\ Vrms$$

When Vin varies in the range of ±10%, Ef varies in the range of −0.2.8% to +2.3%.

In the power supply circuit 100, a DC voltage to be applied to the input terminal Pin and a DC voltage to be applied to the filament terminal F2 are set to the same voltage Vin. It suffices, however, if the DC voltage to be applied to the filament terminal F2 is lower than the induced voltage V0 generated at the node P1. That is, this voltage need not always be equal to the DC voltage Vin applied to the input terminal Pin.

As described above, according to the power supply circuit 100, since the AC filament voltage Ef is generated by using periodic ON/OFF operation of the switching transistor TR when the boosted voltage VDD2 to be applied to the anode 5 and grid 7 of the vacuum fluorescent display tube 1, no filament-driving transformer is required. This can realize a low-noise arrangement.

In addition, this circuit can be comprised of commercially available components, and no transformer design cost is required. In addition, the time required for the design of a power supply can be shortened. Furthermore, the driving period of the filament 6 can be synchronized with the display turn-on period by adjusting the period of a pulse signal from the PWM control circuit 15. This can prevent flicker when a desired pattern is displayed on the vacuum fluorescent display tube 1. Since no transformer is used, low power consumption can be realized.

In addition, since the filament voltage Ef is obtained by using the induced voltage V0 generated at one terminal of the boosting coil L, the voltage loss is small, and the stability of the filament voltage Ef is good. Even when an input voltage changes or is unstable as in battery-driven operation, the stability of the filament voltage Ef is good.

[Second Embodiment]

Figure 4:
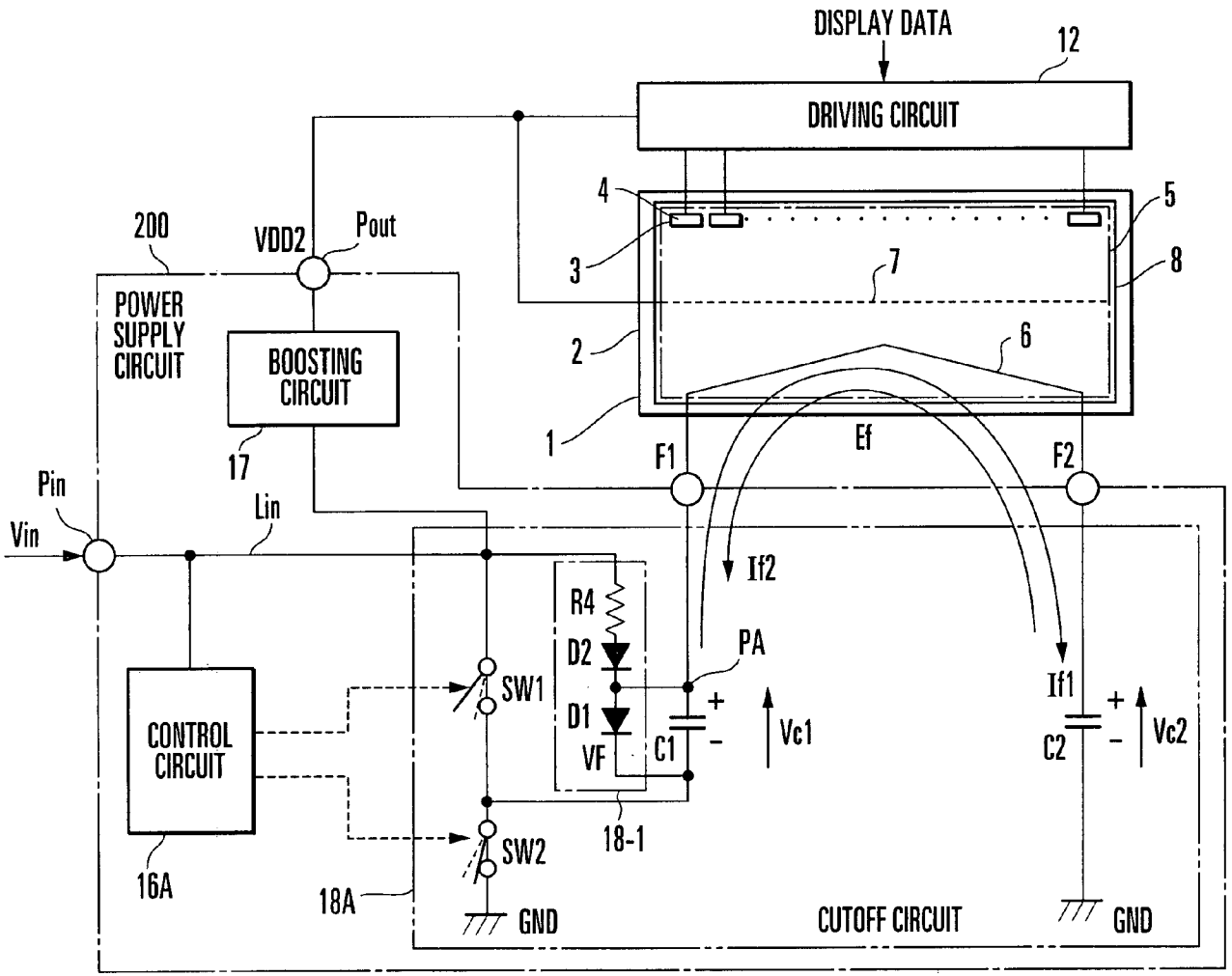
FIG. 4 is a circuit diagram showing the main part of a power supply circuit according to another embodiment (second embodiment) of the present invention.

FIG. 4 shows the main part of a power supply circuit according to another embodiment (second embodiment) of the present invention. A power supply circuit 200 includes a control circuit 16A, boosting circuit 17, and cutoff circuit 18A, and has an input terminal Pin, output terminal Pout, and filament terminals F1 and F2. A DC voltage (input voltage) Vin is applied to the input terminal Pin. A DC voltage VDD2 for the anode/grid is output from the output terminal Pout. A cathode (filament) 6 of a vacuum fluorescent display tube 1 is connected between the filament terminals F1 and F2.

The cutoff circuit 18A includes a first switch SW1, second switch SW2, resistor R, diodes D1 and D2, and capacitors C1 and C2. The switches SW1 and SW2 are connected in series between an input line Lin for a DC voltage Vin and a ground line (GND). In this series connection, the switch SW1 is located on the input line Lin side of the DC voltage Vin and the switch SW2 is located on the ground line side. A series connection circuit 18-1 of a resistor R4 and the diodes D2 and D1 is connected in parallel with the switch SW1.

In the cutoff circuit 18A, the diode D1 is used as a constant-voltage element, and the diode D2 is used as an inverse flow prevention element. The diode D2 is located closer to the input line Lin side for the DC voltage Vin than the diode D1. That is, the anode of the diode D2 is connected to the input line Lin for the power supply voltage Vin via the resistor R4, and the cathode of the diode D2 is connected to the anode of the diode D1. The cathode of the diode D1 is connected to the node between the switches SW1 and SW2. The resistor R4 is used as a resistor for setting a forward current flowing in the diodes D1 and D2.

The capacitor C1 is connected in parallel with the diode D1. That is, one terminal of the capacitor C1 is connected to the anode of the diode D1 (the input terminal of the constant-voltage element), and the other terminal of the capacitor C1 is connected to the cathode of the diode D1 (the output terminal of the constant-voltage element). The filament terminal F1 is connected to a node PA between the anode of the diode D1 and the capacitor C1. The capacitor C2 is connected between the filament terminal F2 and the ground line.

The control circuit 16A uses the DC voltage Vin as operating power and periodically turns on/off the switches SW1 and SW2 of the cutoff circuit 18A in opposite directions. That is, the control circuit 16A periodically repeats the operation of "turning off the switch SW2 when turning on the switch SW1, and turning on the switch SW2 when turning off the switch SW1". The boosting circuit 17 boosts the DC voltage Vin to generate the DC voltage VDD2 for the anode/grid.

Note that the control circuit 16A can adjust a switching period T and duty ratio (on duty and off duty) of the switches SW1 and SW2 when periodically turning on/off them in opposite directions. Letting ton be the time during which the switch SW1 is on (=the time during which the switch SW2 is off), and toff be the time during which the switch SW1 is off (=the time during which the switch SW2 is on), the switching period T is given by T=ton+toff. In addition, an on duty Don of the switch SW1 is represented as Don=ton/T. An off duty Doff of the switch SW1 is represented as Doff=toff/T=(T−ton)/T=1−Don.

[Filament Voltage]

[Waveform Between F1 and GND]

Figure 5:
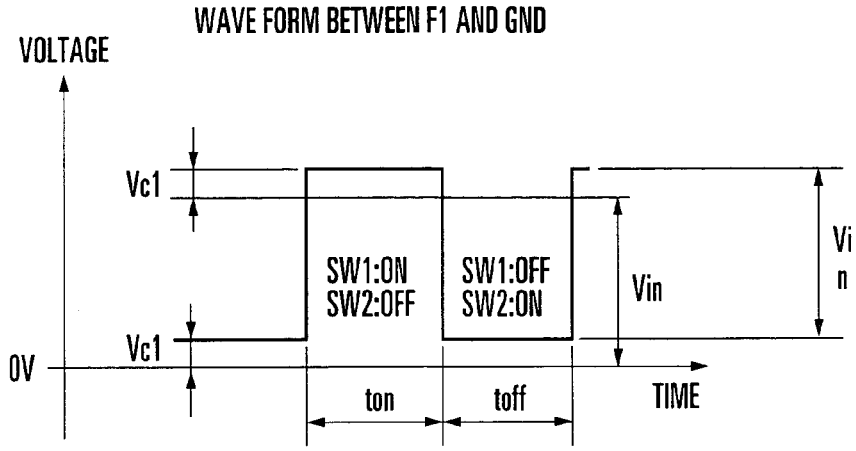
FIG. 5 is a chart showing a voltage waveform (waveform between F1 and GND) appearing at a filament terminal F1 in the second embodiment.

FIG. 5 shows a voltage waveform (a waveform between F1 and GND) appearing at the filament terminal F1 upon ON/OFF control on the switches SW1 and SW2 by the control circuit 16A.

When the switch SW1 is turned off and the switch SW2 is turned on, a current flows through a path constituted by the resistor R4, diode D2, diode D1, and switch SW2, and a charged voltage Vc1 of the capacitor C1 becomes equal to a forward voltage VF of the diode D1. As a consequence, in the interval of toff, the voltage between F1 and GND becomes Vc1=VF.

When the switch SW1 is turned on and the switch SW2 is turned off, the DC voltage Vin is added to the charged voltage Vc1 of the capacitor C1 via the switch SW1, and the potential at the node PA becomes Vin +Vc1. In the interval of ton, therefore, the voltage between F1 and GND becomes Vin+Vc1. In this case, although the potential at the node PA is higher than Vin, no current flows in the input line Lin owing to the inverse flow preventing effect of the diode D2.

[Waveform Between F2 and GND]

Figure 6:
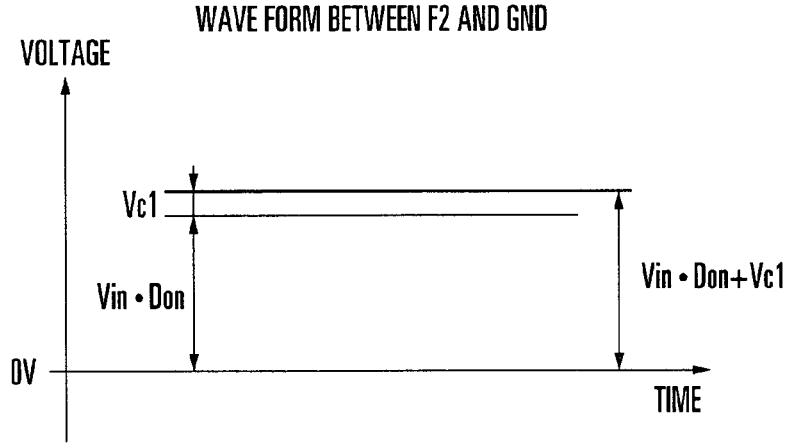
FIG. 6 is a chart showing a voltage waveform (waveform between F2 and GND) appearing at a filament terminal F2 in the second embodiment.

FIG. 6 shows a voltage waveform (waveform between F2 and GND) appearing at the filament terminal F2 upon ON/OFF control on the switches SW1 and SW2 by the control circuit 16A.

When the switch SW1 is turned on and the switch SW2 is turned off, the DC voltage Vin is added to the charged voltage Vc1 of the capacitor C1 via the switch SW1, and the potential at the node PA becomes Vin +Vc1. As a consequence, a current If1 flows in the filament 6, and the capacitor C2 is charged by the current (charging current) If1.

When the switch SW1 is turned off and the switch SW2 is turned on, the potential at the node PA returns to Vc1. As a consequence, a discharge current If2 from the capacitor C2 flows in the filament 6.

A current If1·Don with which the capacitor C2 is charged when the switch SW1 is turned on is equal to a current If2·Doff discharged from the capacitor C2 when the switch SW2 is turned on. If If1·Don>If2·Doff, although Vc2 increases, If2 increases. As a result, Vc2 decreases. If If1·Don<If2·Doff, although Vc2 decreases, If1 increases. As a result, Vc2 increases. In the end, since Vc2 tends to be constant, If1·Don=If2·Doff.

Since If1·Don=If2·Doff, (Vin+Vc1−Vc2)·Don=(Vc2−Vc1)·(1−Don), when the brackets of this equation are removed to simplify the equation, Vin·Don +Vc1·Don−Vc2Don=Vc2−Vc2·Don−Vc1+Vc1·Don. That is, Vin·Don=Vc2−Vc1 is obtained. Therefore, Vc2=Vin·Don+Vc1, and the voltage between F2 and GND becomes Vc2=Vin·Don+Vc1 during both the interval of toff and the interval of ton.

[Waveform Between F1 and F2]

Figure 7:
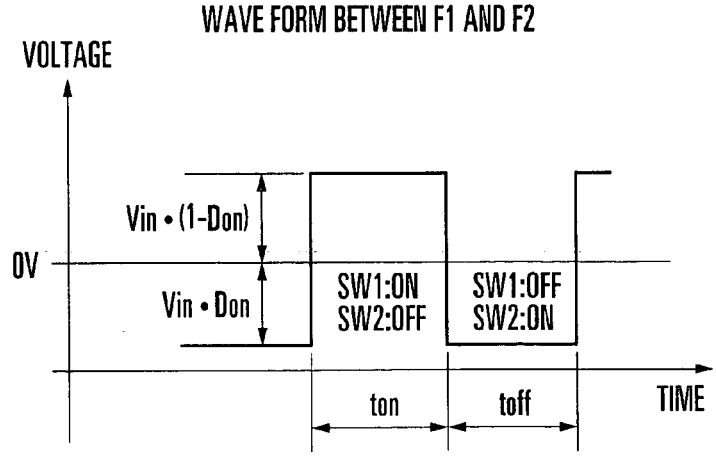
FIG. 7 is a chart showing a waveform (waveform between F1 and F2) between the filament terminals F1 and F2 in the second embodiment.

The voltage waveform between the filament terminals F1 and F2 (waveform between F1 and F2) becomes similar to that shown in FIG. 7 with reference to voltage Vc2=Vin·Don+Vc1 applied to the filament terminal F2. That is, the voltage applied across the filament 6 becomes a voltage having a rectangular waveform (AC filament voltage) with its voltage width represented by Vin owing to ON/OFF control on the switches SW1 and SW2 by the control circuit 16A.

[Effective Value of Filament Voltage]

Letting ef1 be an effective voltage applied across the filament 6 when the switch SW1 is turned on and the switch SW2 is turned off, $ef1=(Vin+Vc1-Vc2)\cdot Don^{1/2}$. Substituting Vc2=Vin·Don+Vc1 into this equation yields $$\begin{aligned} ef1 &= (Vin + Vcl - Vin\cdot Don - Vc1)\cdot Don^{1/2} \\ &= Vin\cdot(1 - Don)\cdot Don^{1/2} \end{aligned} \tag{3}$$

Letting ef2 be an effective voltage applied across the filament 6 when the switch SW1 is turned off and the switch SW2 is turned on, $ef2=(Vc2-Vc1)\cdot Doff^{1/2}=(Vc2-Vc1)\cdot(1-Don)^{1/2}$. Substituting Vc2=Vin·Don+Vc1 into this equation yields $$\begin{aligned} ef2 &= (Vin\cdot Don + Vc1 - Vc1)\cdot(1 - Don)^{1/2} \\ &= Vin\cdot Don\cdot(1 - Don)^{1/2} \end{aligned} \tag{4}$$

An effective value ef of a filament voltage applied across the filament 6 is given by $ef=(ef1^2+ef2^2)^{1/2}$. Squaring the two sides of this equation yields $ef^2=[Vin\cdot(1-Don)\cdot Don^{1/2}]^2+[Vin\cdot Don\cdot(1-Don)^{1/2}]^2=Vin^2\cdot(1-Don)^2\cdot Don+Vin^2\cdot Don^2\cdot(1-Don)=Vin^2\cdot(1-Don)\cdot Don\cdot[(1-Don)+Don]=Vin^2\cdot(1-Don)\cdot Don$. According to this equation, an effective value ef of the filament voltage applied across the filament 6 is given by $$ef=Vin\cdot[(1-Don)\cdot Don]^{1/2} \tag{5}$$

According to equation (5), a condition that maximizes the effective value ef of the filament voltage is Don=0.5, and the effective value ef of the filament voltage is given by ef=0.5Vin when the condition is met. As is obvious from this, in this embodiment, the effective value ef of the filament voltage can be arbitrarily set within the range of ef≦0.5Vin by adjusting the on duty Don of the switch SW1.

[Cutoff Voltage]

In the power supply circuit 200, an average voltage (average voltage on filament terminal F1 side) VF1 at the filament terminal F1 is given by $$\begin{aligned} VF1 &= (Vin + Vc1)\cdot Don + Vc1\cdot(1 - Don) \\ &= Vin\cdot Don + Vc1 \end{aligned} \tag{6}$$

An average voltage (average voltage on filament terminal F2 side) VF2 at the filament terminal F2 is given by $$\begin{aligned} VF2 &= Vc2 \\ &= Vin\cdot Don + Vc1 \end{aligned} \tag{7}$$

Therefore, the cutoff voltage at the filament terminal F1 becomes equal to that at the filament terminal F2. As is obvious from equations (6) and (7), this cutoff voltage can be arbitrarily set by adjusting the charged voltage Vc1 of the capacitor C1, i.e., the forward voltage VF of the diode D1 and the on duty Don of the switch SW1.

Figure 15:
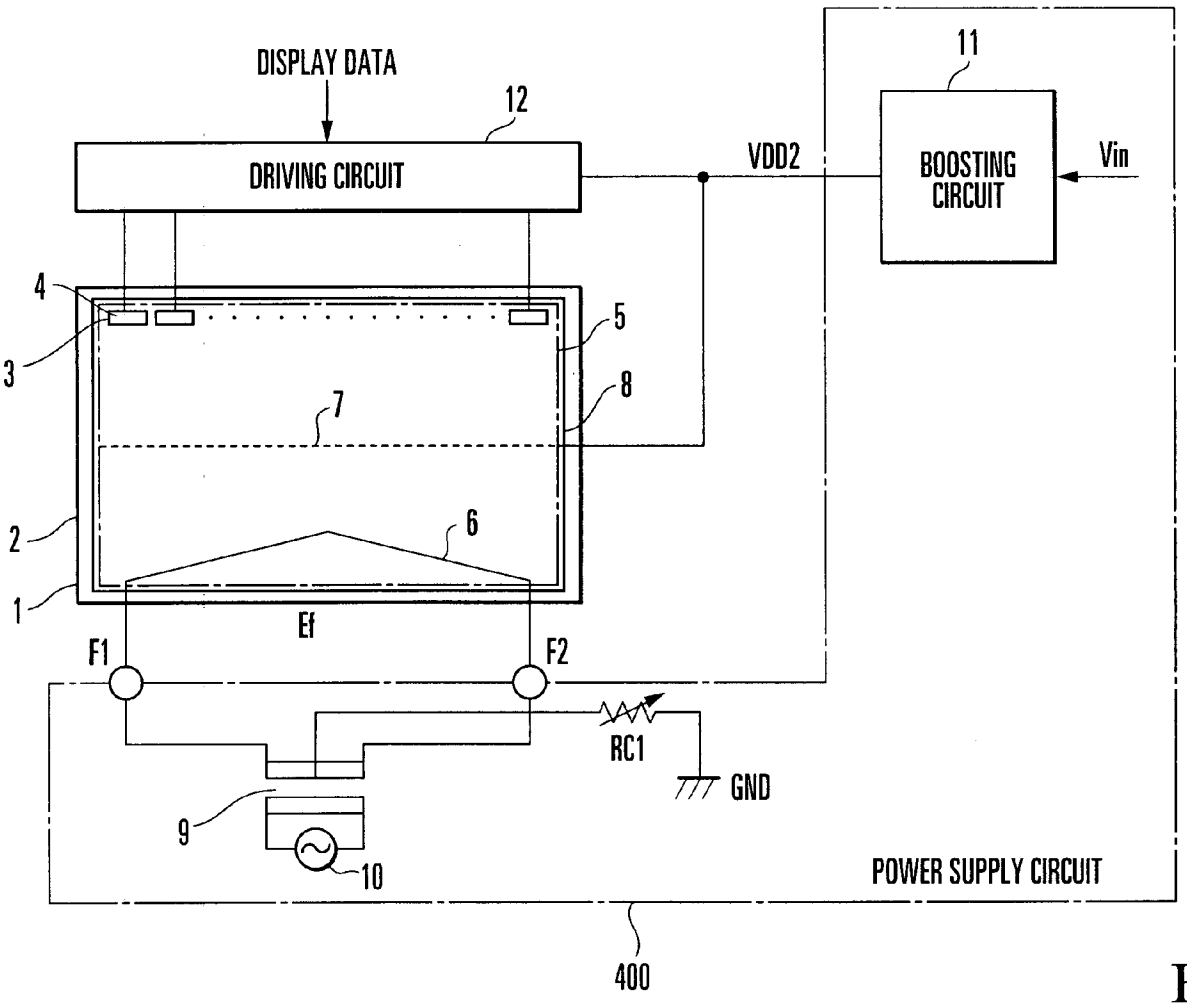
FIG. 15 is a block diagram showing a conventional general vacuum fluorescent display tube and a circuit attached to the vacuum fluorescent display tube.

In the power supply circuit 200, since the cutoff voltage is given by Vin·Don+Vc1 as described above, the cutoff voltage can be set low, increasing the degree of freedom in cutoff voltage. In the conventional power supply circuit 400 shown in FIG. 15, the cutoff voltage can be adjusted by using the resistor RC1. However, the cutoff voltage cannot be decreased below the average voltage between the terminals F1 and F2 and the center tap of the transformer 9. That is, the degree of freedom in designing the cutoff voltage is low. In contrast to this, in the power supply circuit 200 of this embodiment, a cutoff voltage can be arbitrarily set by the forward voltage VF of the diode D1 and the on duty Don of the switch SW1. This increases the degree of freedom in cutoff voltage.

Figure 16:
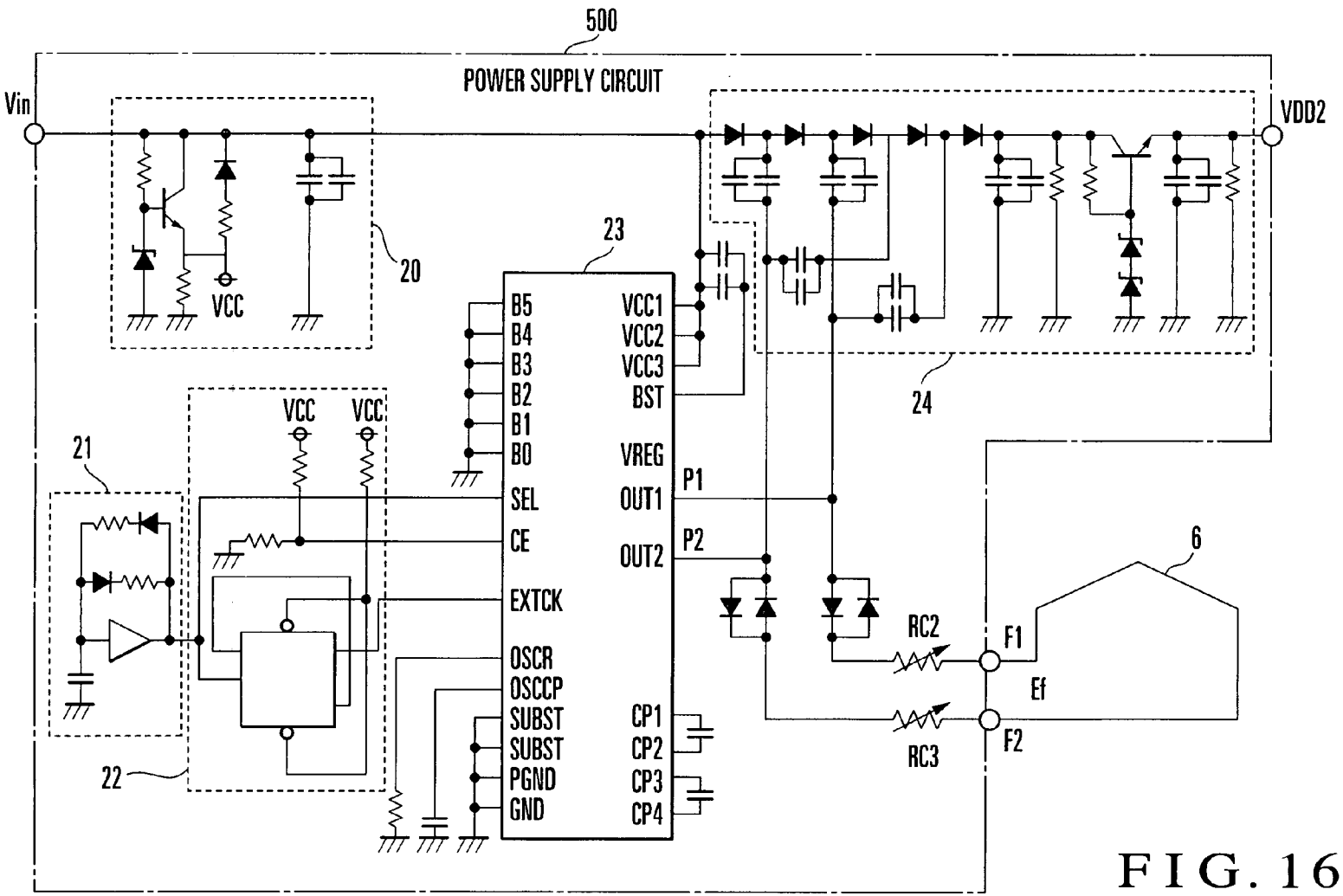
FIG. 16 is a block diagram showing a conventional power supply circuit which generates a DC voltage for the anode/grid and pulse-drives the filament.
Figure 17:
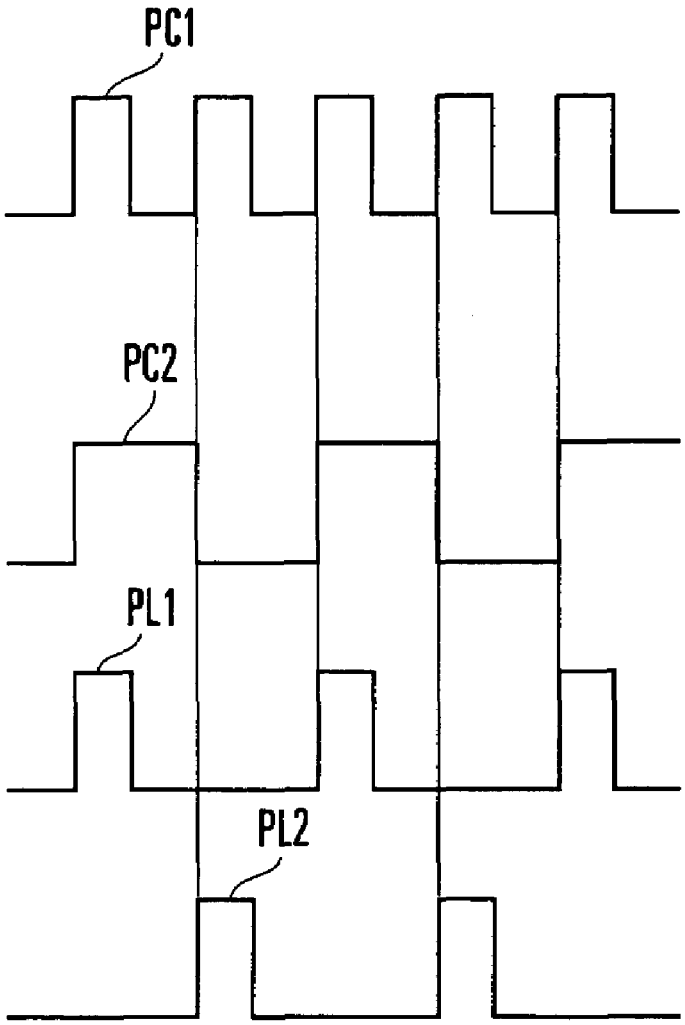
FIG. 17 is a waveform chart showing the operation of this power supply circuit.

Note that the present applicant has previously proposed "Method of Driving Vacuum Fluorescent Display Tube and Driving Circuit" disclosed in reference 2 (Japanese Patent Laid-Open No. 2003-29711). FIG. 16 shows a power supply circuit 500 disclosed in reference 2. FIG. 17 shows the operation of the power supply circuit 500. In the power supply circuit 500, reference numeral 20 denotes a logic power supply which generates DC power VCC from an input voltage (DC voltage) Vin; 21, a reference oscillator which generates a reference clock signal PC1; and 22, a ½ frequency dividing circuit which generates an external clock signal PC2 by dividing the frequency of the reference clock signal PC1 into ½.

Reference numeral 23 denotes a filament driver which outputs complementary differential pulse voltages PLin and P from output terminals OUT1 and OUT2 by switching the input voltage Vin. The differential pulse voltages PLin and P from the filament driver 23 are applied to the filament 6. With this operation, an AC filament voltage Ef is applied across the filament 6 (between the terminals F1 and F2). Reference numeral 24 denotes a boosting circuit which boosts and rectifies the differential pulse voltages PLin and P output from the filament driver 23 and outputs the resultant voltage as a DC voltage VDD2 for the anode/grid.

Referring to FIG. 16, the average voltage between one terminal of the filament 6 and the output terminal OUT1 of the filament driver 23 (the average voltage on the filament terminal F1 side) is equal to the average voltage between the other terminal of the filament 6 and the output terminal OUT2 of the filament driver 23 (the average voltage on the filament terminal F2 side). This average voltage of the filament 6 is set as a cutoff voltage. This cutoff voltage can be adjusted by adjusting the value of a resistor RC2 connected between F1 and OUT1 and the value of a resistor RC3 connected between F2 and OUT2.

In the power supply circuit 500, since the resistors RC2 and RC3 for adjusting the cutoff voltage are connected in series with the filament 6, the input voltage Vin cannot be entirely used as a voltage to be applied to the filament 6 because of voltage drops at the resistors RC2 and RC3. In addition, the power consumed by the resistors RC2 and RC3 is large, and large power is also consumed by the filament 6. That is, the total power consumed is very large. Furthermore, as the filament driver 23, a driver with a power rating and size which endure such power must be used, resulting in an increase in cost. When the filament voltage Ef is to be stabilized, a large loss occurs, resulting in poor efficiency.

In contrast to this, in the power supply circuit 200 of the second embodiment, since a voltage with the voltage width Vin and a rectangular waveform is applied to the filament 6, the entire input voltage Vin is used as a voltage to be applied to the filament 6. In addition, since there is no resistance in the supply path for the input voltage Vin to the filament 6, there is no power consumption due to a resistance, resulting in low power consumption. This makes it possible to reduce the voltage ratings, current ratings, and power consumption capacities of circuit components and to realize reductions in the cost and size of components.

Like the power supply circuit 100 of the first embodiment, the power supply circuit 200 of the second embodiment uses no filament-driving transformer, low noise can be achieved. In addition, no high cost is required for the design of a transformer, and hence the time required for the design of a power supply can be shortened. Furthermore, the driving period of the filament 6 can be synchronized with the display turn-on period by adjusting the ON/OFF periods of the switches SW1 and SW2 from the control circuit 16A. This can prevent flicker when a desired pattern is displayed on the vacuum fluorescent display tube 1.

[Third Embodiment]

Figure 8:
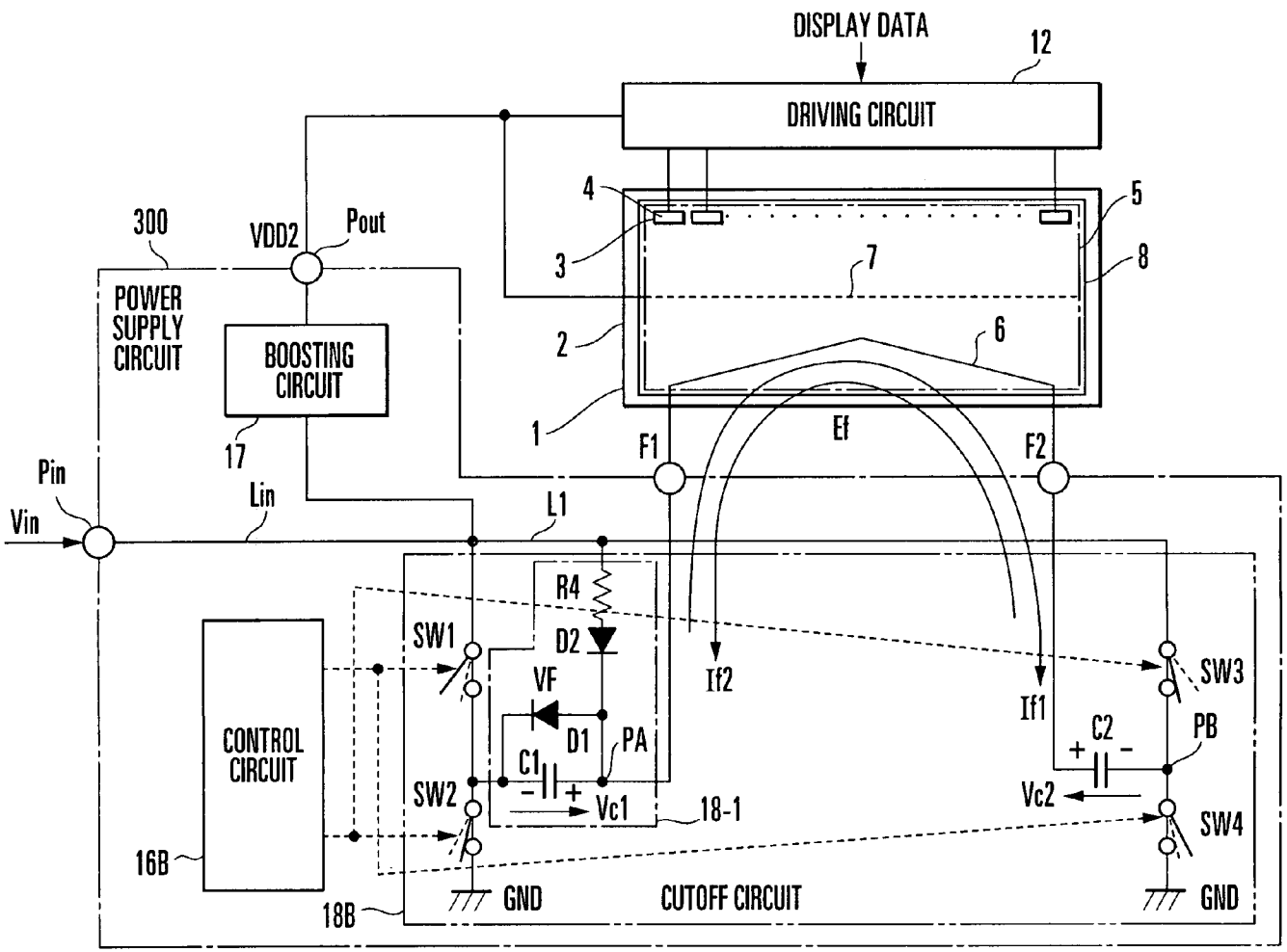
FIG. 8 is a circuit diagram showing the main part of a power supply circuit according to still another embodiment (third embodiment) of the present invention.

FIG. 8 shows an application of the power supply circuit 200 shown in FIG. 4. In a power supply circuit 300, third and fourth switches SW3 and SW4 are connected in series between an input line Lin for a DC voltage Vin and a ground line. In this series connection circuit, the switch SW3 is located on the input line Lin side of the DC voltage Vin, and the switch SW4 is located on the ground line side. A capacitor C2 is connected between a filament terminal F2 and a node PB between the switches SW3 and SW4.

A switch SW1 and the switch SW4 constitute a first switch pair, and a switch SW2 and the switch SW3 constitute a second switch pair. A control circuit 16B periodically and alternately turns on/off the first switch pair (SW1 and SW4) and the second switch pair (SW2 and SW3) in opposite directions.

That is, the control circuit 16B periodically repeats the operation of "simultaneously turning off the second switch pair (SW2 and SW3) when simultaneously turning on the first switch pair (SW1 and SW4), and simultaneously turning on the second switch pair (SW2 and SW3) when simultaneously turning off the first switch pair (SW1 and SW4)".

Figure 9:
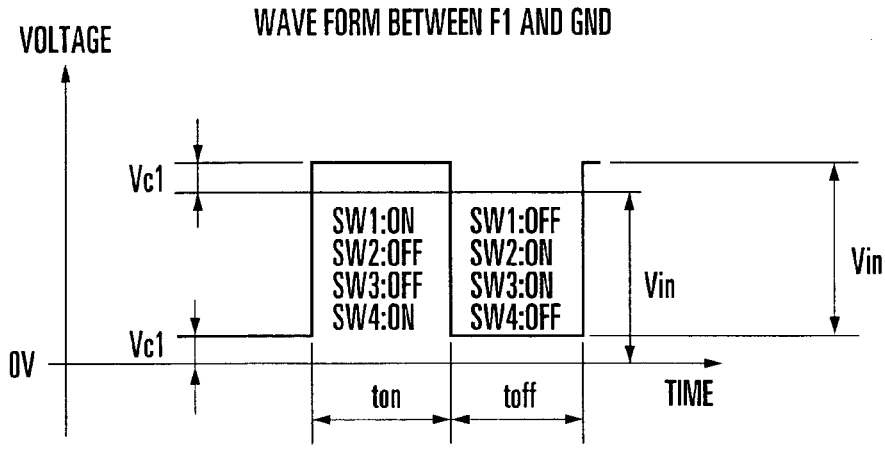
FIG. 9 is a chart showing a voltage waveform (waveform between F1 and GND) appearing at a filament terminal F1 in the third embodiment.
Figure 10:
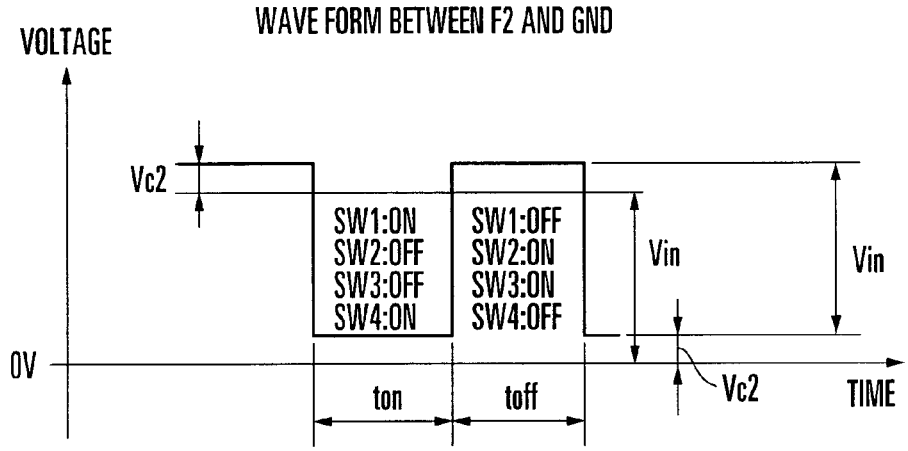
FIG. 10 is a chart showing a voltage waveform (waveform between F2 and GND) appearing at a filament terminal F2 in the third embodiment.
Figure 11:
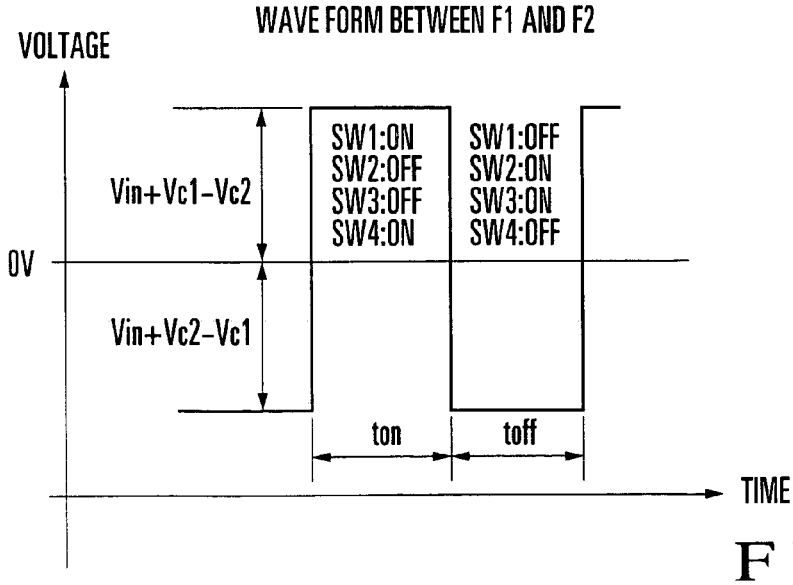
FIG. 11 is a chart showing a waveform (waveform between F1 and F2) between the filament terminals F1 and F2 in the third embodiment.

FIGS. 9, 10, and 11 respectively show a waveform between F1 and GND, a waveform between F2 and GND, and a waveform between F1 and F2, which respectively correspond to FIGS. 5, 6, and 7. As is obvious from these waveforms, in the power supply circuit 300, a voltage with a rectangular waveform (AC filament voltage) is applied to a filament 6 as in the power supply circuit 200. In this case, however, the voltage width of the voltage with the rectangular waveform which is to be applied to the filament 6 is set to 2·Vin.

In the power supply circuit 300, if the on/off duty ratio of the first switch pair (SW1 and SW4) is equal to that of the second switch pair (SW2 and SW3), Vc1=Vc2. In addition, average voltages VF1 and VF2 at the filament terminals F1 and F2 are represented by VF1 =VF2=Vin·Don+Vc1. An effective value ef of a filament voltage is given by ef=Vin·$(2\cdot Don)^{1/2}$.

In the above power supply circuits 200 and 300, switching elements such as transistors and FETs are used as the switches SW1 to SW4. In the series connection circuit 18-1 of the resistor R4 and the diodes D2 and D1 connected to the first switch SW1, the resistor R4 may be provided between the diodes D1 and D2 or between the diode D1 and the node between the switches SW1 and SW2. In addition, the diode D1 is used as a constant-voltage element, and the diode D2 is used as an inverse flow prevention element. However, these elements are not limited to diodes.

Figure 12:
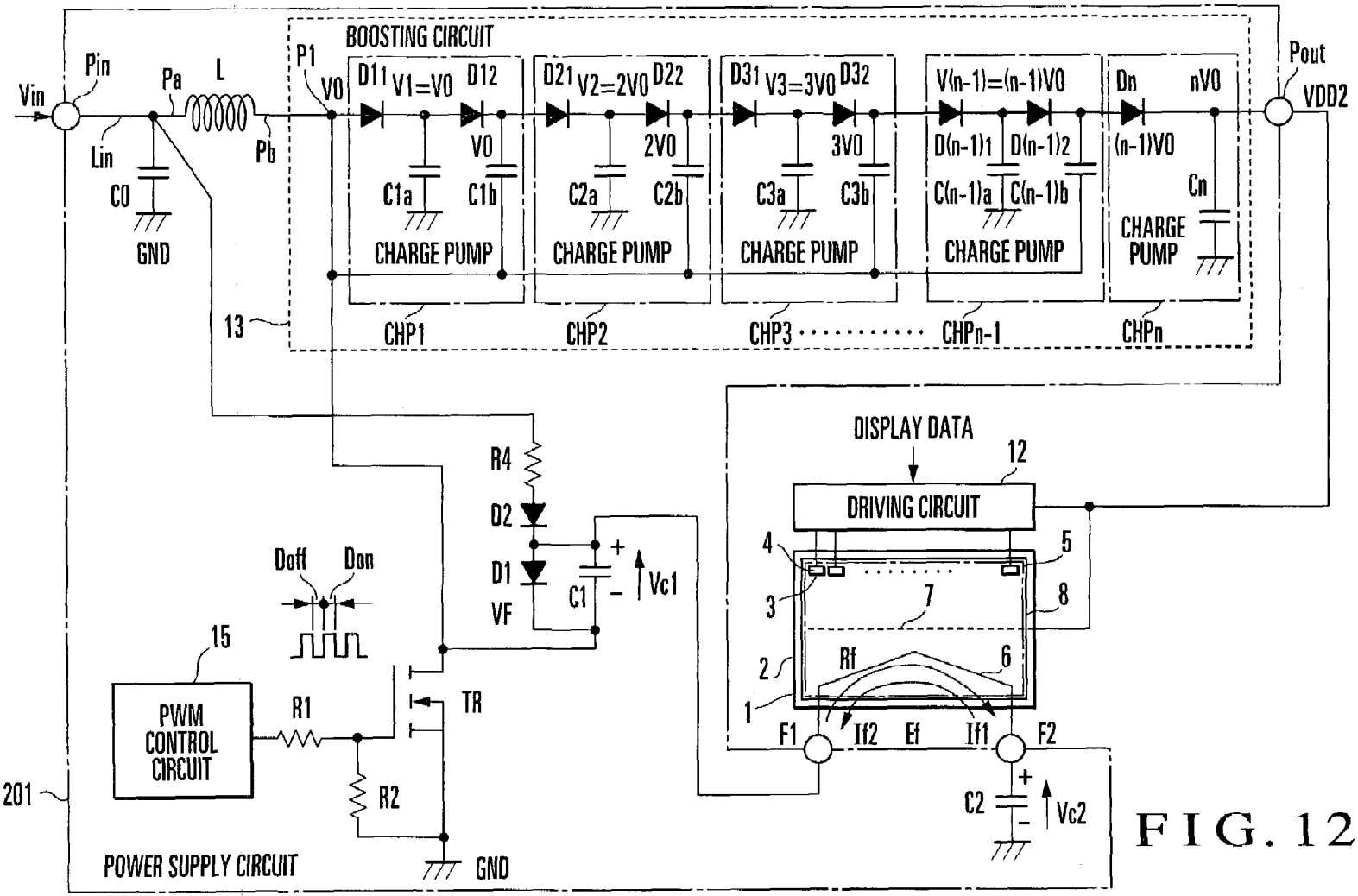
FIG. 12 is a circuit diagram showing the main part of a power supply circuit according to still another embodiment (fourth embodiment) of the present invention.
Figure 13:
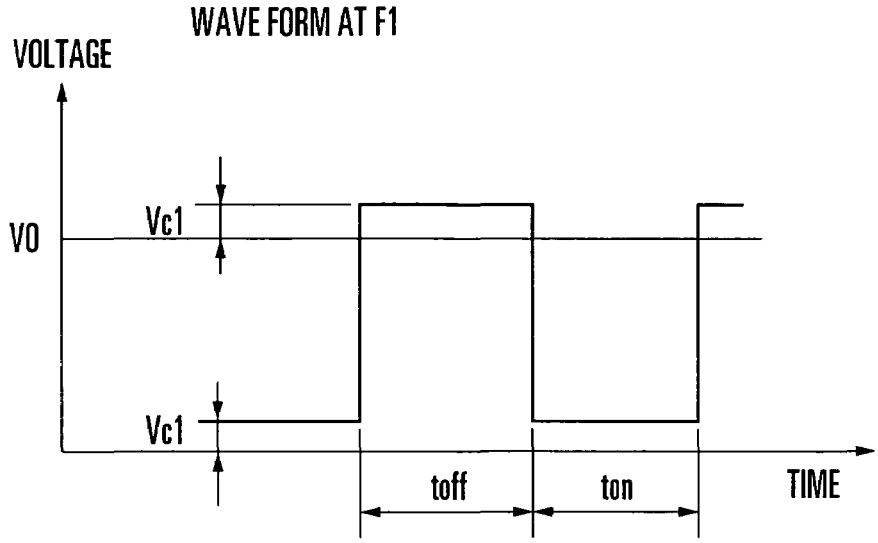
FIG. 13 is a chart showing a voltage waveform (waveform at F1) appearing at a filament terminal F1 in the fourth embodiment.
Figure 14:
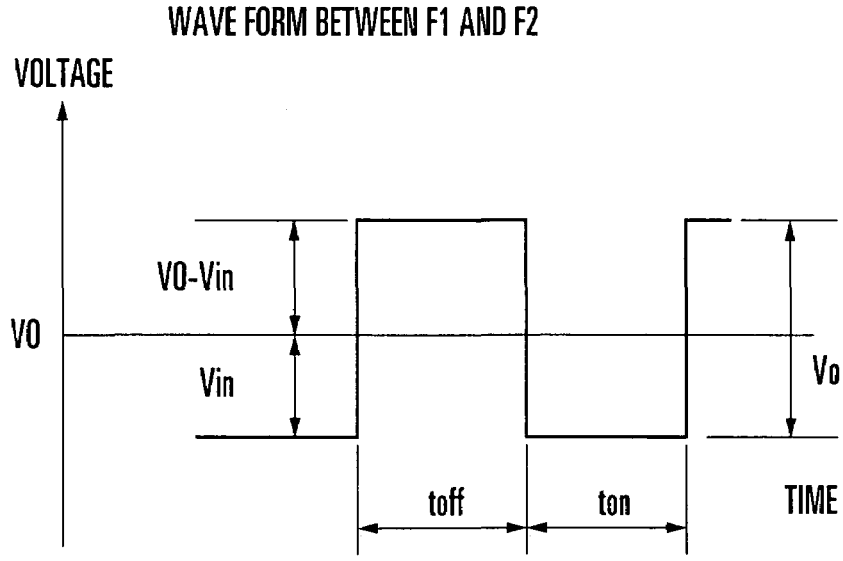
FIG. 14 is a chart showing a waveform (waveform between F1 and F2) between the filament terminals F1 and F2 in the fourth embodiment.

In addition, the technique of the cutoff circuit 18A in the power supply circuit 200 of the second embodiment may be used for the power supply circuit 100 of the first embodiment as in the case of a power supply circuit 201 (fourth embodiment) shown in FIG. 12. FIG. 13 shows a waveform at F1 in the power supply circuit 200 of the second embodiment. FIG. 14 shows a waveform between F1 and F2 in the power supply circuit 201. In the power supply circuit 201, since If1·Doff=If2·Don, [(V0+Vc1−Vc2)/Rf]·(1−Don)=[(Vc2−Vc1)/Rf]·Don, V0+Vc1−Vc2=V0·[(V0−Vin)/V0], and Vc2=Vin+Vc1. Then, VF1=Vin+Vc1, and VF2=Vc2=Vin+Vc1=VF1. A filament voltage Ef can be calculated in the same manner as in the second embodiment.

As has been described above, according to the present invention, since an AC filament voltage is generated by using the periodic ON/OFF operation of switching elements, there is no need to use any filament-driving transformer, and low noise can be achieved. In addition, no high cost is required for the design of a transformer, and the time required for the design of a power supply can be shortened. Furthermore, this can prevent flicker when a desired pattern is displayed on the vacuum fluorescent display tube, and achieve low power consumption.

What is claimed is:

1. A power supply circuit for a vacuum fluorescent display, comprising:

an induction element which is provided in a current path to generate an induced voltage in accordance with a change in current flowing therein;

an input terminal for a DC voltage to one terminal of said induction element;

a switching element which is provided between the other terminal of said induction element and a ground line;

a control circuit which periodically turns on/off said switching element;

a boosting circuit which generates a boosted voltage on the basis of an induced voltage generated at the other terminal of said induction element when said switching element is switched from ON to OFF;

a first terminal connected to a node between the other terminal of said induction element and said switching element;

a second terminal to which a DC voltage lower than the induced voltage generated at the other terminal of said induction element is applied; and a variable resistor provided on a connection line between the first terminal and the node between the other terminal of said induction element and said switching element.

2. A power supply circuit for a vacuum fluorescent display, comprising:

series-connected first and second switching elements provided between an input line for a DC voltage and a ground line with said first switching element being located closer to the input line for the DC voltage than said second switching element;

a series connection circuit including a resistor, an inverse flow prevention element, and a constant voltage element which are connected in series with each other, with the inverse flow prevention element being connected in parallel with said first switching element so as to be located closer to the input line for the DC voltage than the constant voltage element;

a first capacitor connected between an input terminal and an output terminal of the constant voltage element;

a first terminal connected to a node between the input terminal of the constant voltage element and said first capacitor;

a second capacitor connected between a second terminal and the ground line; and control means for alternately turning on/off said first switching element and said second switching element.

3. A power supply circuit for a vacuum fluorescent display, comprising:

series-connected first and second switching elements provided between an input line for a DC voltage and a ground line with said first switching element being located closer to the input line for the DC voltage than said second switching element;

series-connected third and fourth switching elements provided between the input line for the DC voltage and the ground line with said third switching element being located closer to the input line for the DC voltage than said fourth switching element;

a series connection circuit including a resistor, an inverse flow prevention element, and a constant-voltage element which are connected in series with each other, with the inverse flow prevention element being connected in parallel with said first switching element so as to be located closer to the input line for the DC voltage than the constant-voltage element;

a first capacitor connected between an input terminal and an output terminal of the constant-voltage element;

a first terminal connected to a node between the input terminal of the constant-voltage element and said first capacitor;

a second capacitor connected between a second terminal and a node between said third switching element and said fourth switching element; and control means for alternately turning on/off a first switching element pair and a second switching element pair, the first switching element pair including said first switching element and said fourth switching element, and the second switching element pair including said second switching element and said third switching element.

* * * * *